United States Patent [19]

Mucciarone

[11] Patent Number: 4,921,117

[45] Date of Patent: May 1, 1990

[54] POP-ART TUMBLER

[76] Inventor: Domenick Mucciarone, 3645 Boca Ciega Dr., Apt. 206, Naples, Fla. 33962

[21] Appl. No.: 196,608

[22] Filed: May 20, 1988

[51] Int. Cl.[5] ..... B65D 23/00

[52] U.S. Cl. ..... 220/85 H; 220/90.2; 220/903

[58] Field of Search ..... 220/90.2, 85 H, 71, 220/903, 1 BC, 1 R; 206/45.34; 40/306, 310

[56] References Cited

U.S. PATENT DOCUMENTS

| | | | |
|---|---|---|---|
| 2,715,326 | 8/1955 | Gits | 220/1 R |
| 3,469,735 | 9/1969 | Burt | 220/85 SP |
| 3,738,529 | 6/1973 | Rose | 220/903 |
| 3,813,801 | 6/1974 | Vander Schaaf | 220/903 |
| 3,941,237 | 3/1976 | MacGregor | 220/85 H |
| 4,278,167 | 7/1981 | van Rossem | 206/45.34 |
| 4,548,349 | 10/1985 | Tunberg | 220/85 H |
| 4,681,239 | 7/1987 | Manns | 220/903 |
| 4,747,507 | 5/1988 | Fitzgerald | 220/85 H |
| 4,768,673 | 9/1988 | Przytulla | 220/71 |
| 4,813,453 | 3/1989 | Jenkins | 137/588 |

*Primary Examiner*—Stephen Marcus
*Attorney, Agent, or Firm*—William F. Hamrock

[57] ABSTRACT

A tumbler for consumption of beverage and food is prepared by removing the metal top from a standard aluminum can and fitting a thin plastic sleeve over the exterior side walls thereof. Said tumbler is reuseable, extremely strong and unbreakable, and has a glass-like feel. The can is easily replaced by slipping it out of the plastic sleeve and inserting a new can therein. The invention unexpectedly permits the reuse of empty, discarded aluminum cans but still allows recycling of the cans after being replaced in the plastic sleeve.

16 Claims, 2 Drawing Sheets

POP-ART TUMBLER

BACKGROUND OF THE INVENTION

1. Field of the Invention

This invention relates to a novel reuseable tumbler, named Pop-Art Tumbler, prepared by snugly fitting a thin plastic sleeve over an empty standard aluminum can after its metal top has been removed with a conventional can opener. Even more particularly, this invention relates to economically converting empty discarded aluminum cans into reuseable, unbreakable, colorful, all-purpose tumblers to be used for the consumption of beverage and food.

2. Description of the Prior Art

Standard aluminum beverage and food cans are made of quality materials and are identified by artistic designs having high aesthetic value. Although these cans are capable of being reused they have very thin, easily crushable side walls and are discarded after the contents are removed which is an appalling waste of quality products as well as their aesthetic value. Even though some discarded aluminum cans are recycled, this does not excuse the waste attributed to discarding quality products with such artistic designs after one use.

Most prior art holders of beverage cans are for the purpose of insulation to keep the contents of the cans cold, by trapping and sealing air in a chamber or space between the exterior wall of the can and the interior wall of a jacket or holder with the use of gaskets and zippers, and of holding the cans while drinking therefrom. U.S. Pat. Nos. 3,905,511; 4,383,422 and 4,478,265 are examples of the prior art which relate, in particular, to insulating jackets for beverage cans. U.S. Pat. No. 3,013,691 particularly relates to a handled holder for beverage cans which also insulates the can. In all of these cases, the empty cans are discarded after use. There is no prior art which recognizes that empty aluminum cans can be converted into reuseable, strong, durable, unbreakable tumblers with enhanced artistic features at a minimal cost by the use of the unique plastic sleeve of the present invention.

Thus, it is seen that a problem of shocking wastefulness exists by discarding empty aluminum cans after their contents have been removed. There is a need to be able to easily and inexpensively convert discarded cans into reuseable tumblers having excellent properties and at the same time to preserve the aesthetic value of the artistic designs thereof. The present invention satisfies this need in the art by providing a unique sleeve structure which solves these problems.

SUMMARY OF THE INVENTION

Accordingly, it is an object of this invention to provide a reuseable, unbreakable, aesthetic, all-purpose tumbler with glass-like touch.

Another object is to easily convert empty aluminum cans into reuseable, unbreakable, aesthetic, all purpose tumblers by use of an inexpensive plastic sleeve structure.

A further object is to provide a unique reuseable locking spacer collar to adapt different type standard aluminum cans to the unique plastic sleeve struture.

An even further object is to fully utilize the quality materials and to preserve the artistic designs of the standard aluminum cans in the reuseable tumbler.

Another further object is to be able to easily replace the can in the sleeve with a new can.

Another even further object is still to be able to recycle the can after it has been replaced.

The above objects are met by providing an inexpensive, thin plastic sleeve having such dimensions and structure as to snugly fit skin-tight over the exterior cylindrical wall of a can after the top of the can has been removed with a conventional can opener. The use of a unique locking spacer collar in conjunction with said plastic sleeve permits said sleeve to be used on practically all standard aluminum cans. The above arrangements result in a reuseable, strong, unbreakable, aesthetic, all-purpose tumbler with glass-like feel.

DETAILED DESCRIPTION

The invention will be described in detail with reference to the figures where appropriate.

Figure 1:
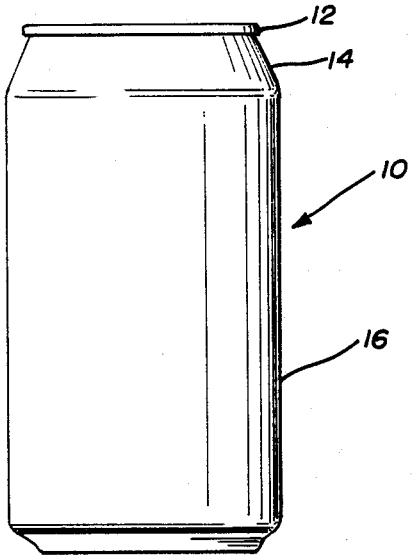
FIG. 1 is a side elevation view of a standard aluminum Type "A" can.
Figure 2:
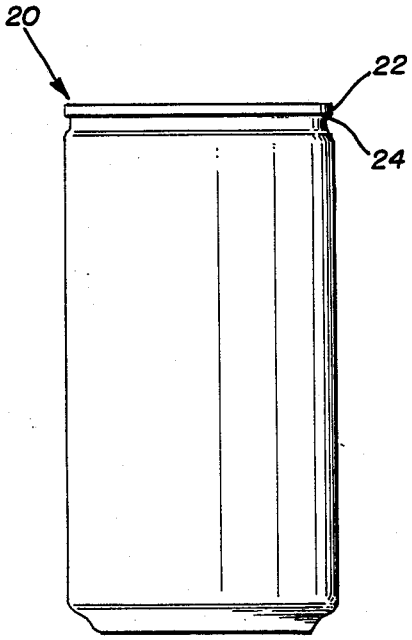
FIG. 2 is a side elevation view of a standard aluminum Type "B" can.
Figure 8:
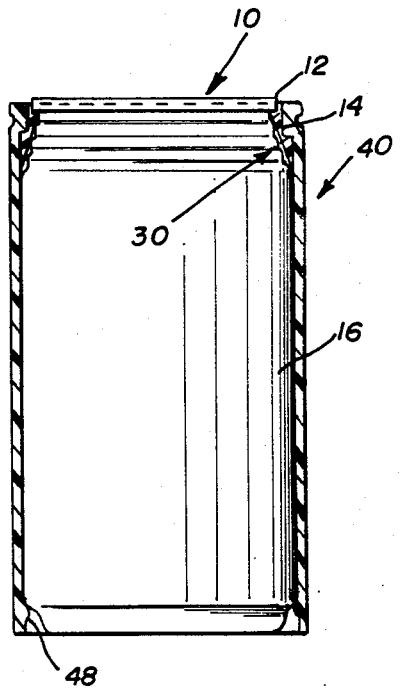
FIG. 8 is a cross-section of a sleeve with a locking spacer collar and Type "A" can inside.
Figure 10:
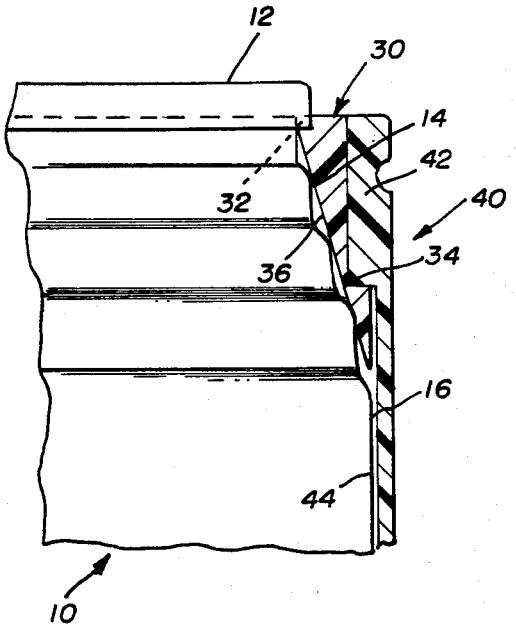
FIG. 10 is an enlarged partial cross-section of a sleeve and locking spacer collar locked in place on a Type "A" can.

FIGS. 1 and 2 show the two standard aluminum cans, Type A 10 and Type B 20, which are presently used to market beverages and food. The dimensions of the cans are about the same except that the diameter of the top rim 12 and the space 14 below said top rim of Type A have smaller diameters than the top rim 22 and space 24 below that top rim of Type B can. Thus, Type A can requires a locking spacer collar to be fitted over top rim 12 and encompasses the space 14 below the rim. Type B can does not require such a locking collar. The metal surface of space 14 below the top rim of Type A can 10 can be smooth as shown in FIG. 1 or rippled as shown in FIGS. 8 and 10.

Figure 5:
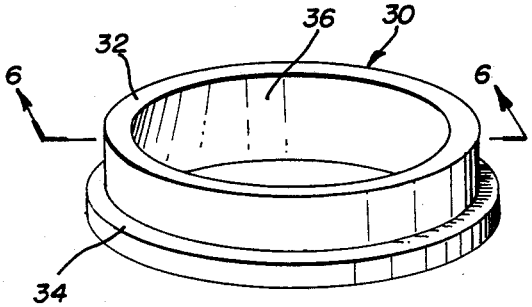
FIG. 5 is a perspective view of a locking spacer collar of the inventio.
Figure 6:
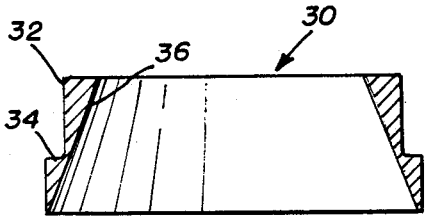
FIG. 6 is a section take along line 6—6 of FIG. 5.

A preferred embodiment of a locking spacercollar is shown in FIGS. 5 and 6. Locking spacer collar 30 can be made of a semi-rigid plastic or similar material which can be either molded into a cylindrical piece or otherwise joined together at a seam. The locking spacer collar 30 comprises top bead 32, shelf 34 and interior wall 36 as shown in FIGS. 5 and 6. Locking spacer collar 30 is force fitted over top rim 12 of can "A" and snugly encoompasses the space below said top rim 14. It almost completely encompasses rim 12 except for the top edge of the rim which is slightly exposed.

Figure 3:
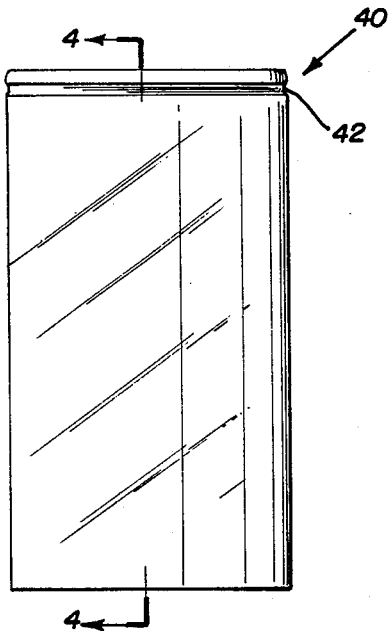
FIG. 3 is a side elevation view of a plastic sleeve of the invention.
Figure 4:
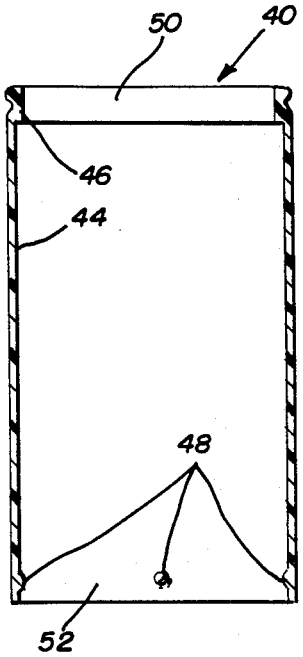
FIG. 4 is a cross-sectional view of the plastic sleeve along line 4—4 of FIG. 3.

FIGS. 3 and 4 illustrate a preferred embodiment of the removable cylindrical sleeve of the invention. Sleeve 40 as shown may be made of thin plastic, or other material, about 1/16 inch in thickness or less.

Although shown to be seamless and transparent, it is not to be so limited. Alternately, it can be prepared from sheet material with the sides subsequently sealed together to form a seam as well as being any color and containing any design so desired. A preferred embodiment is the use of a clear plastic sleeve which enhances and preserves the aesthetic value of the artistic designs on the cans. Acrylates are the preferred plastics.

As shown in FIGS. 3 and 4, sleeve 40 comprises lip recess 42, interior wall 44, sleeve spacer 46, locking lug 48, top open end 50 and bottom open end 52. The plastic sleeve is generally about the same height as Type A and B cans. The sleeve snugly fits skin-tight over the exterior walls of the can.

FIGS. 8 and 10 are directed to a preferred embodiment wherein locking spacer collar 30 and sleeve 40 have been fitted on Type A can 10. After the top of the can has been removed, locking sleeve collar 30 is force fitted over top rim bead 12 and snugly encompass space 14. The sleeve 40 is then placed on the can by positioning the open ended bottom 52 of the sleeve over the top of the can with the sleeve bottom locking lug 48 positioned to move downward over the exterior wall 16. The can is then pushed upward into sleeve 40 until the top of the sleeve comes in contact with locking spacer collar 30 which has been affixed to the space below an top rim bead 14. A small portion of the bottom of can 10 may be exposed below the sleeve bottom 52. A slight rap then to the bottom of the can will cause both the top sleeve lip 42 to position the sleeve spacer 46 on locking spacer shelf 34 and the sleeve bottom locking lug 48 to position at the can bottom.

As shown in FIG. 10, sleeve spacer 46 tightly secures and compresses the locking spacer cellar top bead 32 below the container top rim bead 12. The locking spacer collar top bead 32 partially encompasses the top rim bead 12 of the can. The can top rim bead 12 is then slightly exposed above the top sleeve lip 42 and the locking spacer collar top bead 32. With the aid of the sleeve bottom locking lug 48 the can is firmly housed within sleeve 40. The interior sleeve wall 44 snugly fit skintight over the can exterior wall 16. The smooth surfaces contact of said walls creates limited friction against each other and results in minimal air space therebetween as well as enormously increasing the strength of the tumbler. In a further embodiment, the locking hug 48 may not be present.

Figure 7:
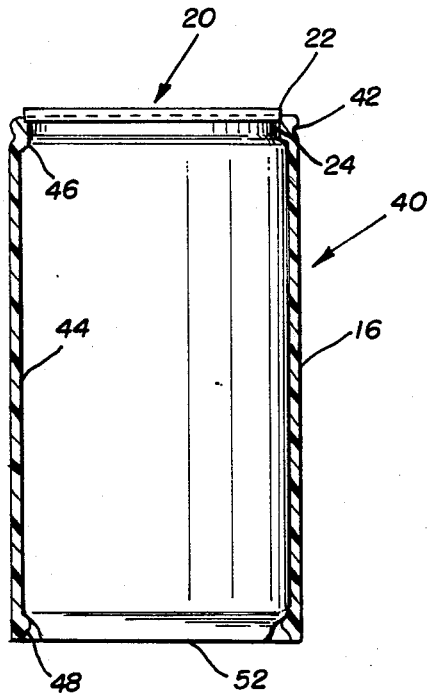
FIG. 7 is a cross-section of a sleeve with a Type "B" can inside.
Figure 9:
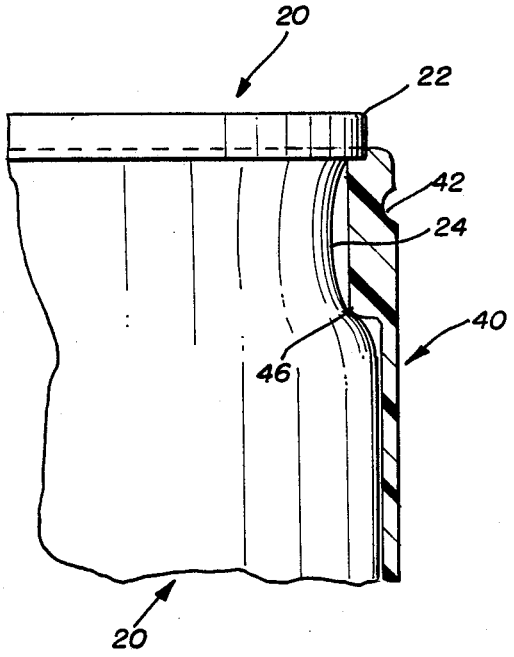
FIG. 9 is an enlarged partial cross-section of a sleeve showing it locked in place on a Type "B" can.

Sleeve 40 is applied to Type B can 20 in the same manner as applied to Type A can 10. Since there is no requirement for a locking spacer collar, the top lip 42 and sleeve spacer 46 of the sleeve firmly contact the space 24 below the top rim bead 22 of Type B can as shown in FIGS. 7 and 9. The bottom locking lug 48 of the sleeve is firmly positioned at the can bottom as shown.

In operation, Type A and Type B cans are prepared by removing the metal tops with a conventional wheel type can opener. Type A can 10 requires locking spacer collar 30 to be force fitted on and snugly fit into the space below the can top rim 14. The sleeve 40 open-ended bottom 52 is slipped on can top rim bead 12, the can 10 is pushed upwardly into the sleeve 40 thus housing itself firmly within the sleeve 40.

The Type B can top rim bead 22 is slipped into sleeve 40 open-ended bottomo 52, the can is pushed upwardly into the sleeve 40 thus housing itself firmly within the sleeve 40.

Both the locking collar interior 36 and the interior wall of sleeve spacer 46 can be made to conform closely to the surface of space 14 and 24 respectively so as to snugly encompass said space.

Whereas an individual empty can can be easily crushed and dented and an individual sleeve can be fairly easily broken, when Type A and B cans are housed in the sleeve 40, an extremely strong, unbreakable tumbler is made at a minimal cost. It is unexpected that the thin aluminum can housed within the thin plastic sleeve would have such improved properties.

Since clear sleeve 40 enhances and preserves the colorful arts of the aluminum beverage and food cans, the tumbler is named Pop-Art Tumbler. The thin aluminum cans are made of high quality materials which are not wasted. The thin sleeve 40 adds a longer useful life to aluminum cans.

The Pop Art Tumbler can be used for most beverages and food in and out of doors. It is reuseable and washable. A plastic cover can fit over the top of the tumbler if so desired.

Type A and B cans are interchangeable using the same sleeve 40. The cans are easily removed from sleeve 40 for reuse of either type of can by inserting an object into the can and rapping the inserted object downward. The can then will pop out of the sleeve.

While the foregoing sets forth the present invention, it will be apparent that modification is possible without departing from the spirit and scope of the invention.

What is claimed is:

1. A rigid, unbreakable tumbler having a glass-like feel comprising a cylindrical aluminum can snugly enclosed within a reuseable thin, plastic sleeve, said can being completely open at the top end and closed at the bottom end and having a cylindrical side wall having a top end exterior bead of greater diameter than the exterior wall neck space immediately below said bead, said sleeve comprising a cylindrical thin plastic side wall open at the top and bottom ends and having an interior sleeve spacer at the top end of the inner wall, the exterior diameter of said can wall and the interior diameter of said sleeve wall being about equal, the height of said can being slightly greater than said sleeve, whereby said can is snugly secured skin-tight within said sleeve by pushing said can upward into said sleeve thereby locking said interior sleeve spacer at the top.

2. A tumbler according to claim 1 wherein said sleeve has an interior locking lug immediately above the bottom end, said locking lug being locked in place at the bottom of the can.

3. A tumbler according to claim 2 wherein the exterior wall space of the can immediately below said bead is snugly enclosed within a locking spacer collar.

4. A tumbler according to claim 2 wherein said sleeve is transparent.

5. A tumbler according to claim 4 wherein said sleeve is seamless.

6. A tumbler according to claim 5 wherein the wall thickness of said sleeve is about one-sixteenth of an inch.

7. A tumbler according to claim 6 wherein the exterior wall space of the can immediately below said bead is enclosed within a locking spacer collar.

8. A tumbler according to claim 1 wherein the exterior wall space of the can immediately below said bead is enclosed within a locking spacer collar.

9. A reusable sleeve for snugly enclosing topless, cylindrical aluminum Type A cans comprising a plastic sleeve including a cylindrical, rigid, thin plastic side wall with completely open top and bottom ends and an inwardly projecting slightly thickened rim spacer adjacent to the top end of the sleeve inner wall, in combination with a cylindrical plastic ring locking spacer collar fitted within said top rim spacer of said sleeve wall, the exterior surface of the sleeve wall having a glass-like feel, the interior diameter of said sleeve wall being about equal to the exterior side wall diameter of an aluminum Type A can, the height of said sleeve being slightly less than an aluminum Type A can.

10. A reuseable sleeve according to claim 9 wherein said sleeve is transparent.

11. A reuseable sleeve according to claim 10 wherein said sleeve is seamless.

12. A reuseable sleeve according to claim 11 wherein the wall thickness of said sleeve is about one-sixteenth of an inch.

13. A reuseable sleeve according to claim 12 having an interior locking lug positioned immediately above the bottom end of the inner wall.

14. A method of providing a plastic sleeve to convert standard beverage and food cans into rigid, reuseable tumblers comprising said plastic sleeve having a cylindrical side wall completely open at the top and bottom ends and an inwardly projecting slightly thickened top rim spacer, said cans having cylindrical side walls, top and bottom walls and indented neck areas immediately below a top bead, completely removing said top walls from said cans, pushing the top end of said cans upwardly into said sleeve until said top bead of the cans contacts said rim spacer of the sleeve.

15. The method according to claim 14 wherein a reuseable, cylindrical, plastic locking spacer collar comprising an annular top bead extending from an outwardly projecting horizontal annular shelf is force fitted into said indented space below the top bead of the cans and said cans are then pushed upwardly into said sleeve until the annular shelf of the collar contacts the rim spacer of the sleeve.

16. The method according to claim 14 wherein said plastic sleeve comprises a cylindrical, rigid, thin plastic side wall, completely open top and bottom ends and an inwardly projecting slightly thickened rim spacer adjacent to the top end of the sleeve inner wall, the exterior surface of the sleeve wall having a glass-like feel, the interior diameter of said sleeve wall being about equal to the exterior side wall diameter of said cans, the height of said sleeve being slightly less than said cans.

* * * * *